US006837793B2

(12) United States Patent
McClintic

(10) Patent No.: US 6,837,793 B2
(45) Date of Patent: Jan. 4, 2005

(54) METHOD AND APPARATUS FOR GAMING MACHINES WITH A QUASI-COMPETITION PLAY BONUS FEATURE

(75) Inventor: Monica A. McClintic, Boulder City, NV (US)

(73) Assignee: IGT, Reno, NV (US)

( * ) Notice: Subject to any disclaimer, the term of this patent is extended or adjusted under 35 U.S.C. 154(b) by 55 days.

(21) Appl. No.: 10/027,888

(22) Filed: Dec. 19, 2001

(65) Prior Publication Data

US 2003/0114218 A1 Jun. 19, 2003

(51) Int. Cl.[7] ..... A63F 9/24
(52) U.S. Cl. ..... 463/42; 463/25
(58) Field of Search ..... 463/16–22, 25, 463/40–42, 78; 273/138.1, 138.2, 139, 143 R, 236–237, 292–293; 700/91–93

(56) References Cited

U.S. PATENT DOCUMENTS

| | | | | |
|---|---|---|---|---|
| 4,582,324 | A | | 4/1986 | Koza et al. |
| 4,738,451 | A | * | 4/1988 | Logg ..... 463/2 |
| 4,805,907 | A | | 2/1989 | Hagiwara |
| 4,856,787 | A | | 8/1989 | Itkis |
| 4,926,327 | A | | 5/1990 | Sidley |
| 5,159,549 | A | | 10/1992 | Hallman, Jr. et al. |
| 5,242,163 | A | | 9/1993 | Fulton |
| 5,265,874 | A | | 11/1993 | Dickinson et al. |
| 5,333,868 | A | | 8/1994 | Goldfarb |
| 5,342,049 | A | | 8/1994 | Wichinsky et al. |
| 5,351,970 | A | | 10/1994 | Fioretti |

(List continued on next page.)

FOREIGN PATENT DOCUMENTS

| | | |
|---|---|---|
| AU | 718243 | 4/2000 |
| EP | 0 896 308 | 2/1999 |
| EP | 1 253 563 | 10/2002 |
| GB | 2 062 922 A | 5/1981 |
| GB | 2 072 395 A | 9/1981 |
| GB | 2 092 796 A | 8/1982 |
| GB | 2 197 974 A | 6/1988 |
| GB | 2 226 436 A | 6/1990 |
| GB | 2 229 565 A | 9/1990 |
| GB | 2 320 206 A | 6/1998 |
| WO | WO 98/51384 | 11/1998 |
| WO | WO 01/33478 | 5/2001 |

OTHER PUBLICATIONS

NBA Jam Extreme review by Games Domain [www.games-domain.com/gdreview/zones/reviews/pc/apr97/nba.htmll], Game's Release Date: Dec. 1996, Publisher: Acclaim, pps. 1–4.*

U.S. Appl. No. 10/029,381, filed Dec. 19, 2001, titled "Method and Apparatus for An Interactive Bonus Game.".

Amendment, filed in regard to U.S. Appl. No. 10/029,381, dated May 6, 2004.

Office Action, issued in regard to U.S. Appl. No. 10/029,381, dated Jan. 6, 2004.

*Primary Examiner*—Mark Sager
(74) *Attorney, Agent, or Firm*—Marshall, Gerstein & Borun LLP

(57) ABSTRACT

The present invention provides a player an enhanced gaming experience by using strategy and random selection to impart at least the perception of elements of skill to players to provide access to quasi-competitive bonus games for players of different skill levels. The gaming machines of the present invention are configured to offer the features of a conventional gaming machine, such as, for example, a primary game in the form of a reel-type game or a video card game, but also enable entry into a quasi-competitive bonus game. In exemplary embodiments, the gaming machines of the present invention are networked to enable interactive bonus game play among more than one player or between a player and a computer. Players may select or adopt and modify a particular character for bonus game play, and team play between teams of players may also be offered.

20 Claims, 5 Drawing Sheets

U.S. PATENT DOCUMENTS 5,560,603 A 10/1996 Seelig et al.
5,580,308 A 12/1996 Nakamura
5,664,998 A 9/1997 Seelig et al.
5,720,663 A * 2/1998 Nakatani et al. ..... 463/23
5,769,716 A 6/1998 Saffari et al.
5,779,544 A 7/1998 Seelig et al.
5,779,549 A 7/1998 Walker et al.
5,796,716 A 8/1998 Smith
5,806,045 A 9/1998 Biorge et al.
5,820,460 A 10/1998 Fulton
5,833,536 A 11/1998 Davids et al.
5,851,148 A 12/1998 Brune et al.
5,876,284 A 3/1999 Acres et al.
5,902,983 A 5/1999 Crevelt et al.
5,911,418 A 6/1999 Adams
5,947,820 A 9/1999 Morro et al.
5,951,397 A 9/1999 Dickinson
5,971,849 A 10/1999 Falciglia
6,012,982 A 1/2000 Piechowiak et al.
6,024,643 A 2/2000 Begis
6,039,648 A * 3/2000 Guinn et al. ..... 463/16
6,050,895 A 4/2000 Luciano, Jr. et al.
6,142,872 A 11/2000 Walker et al.
6,146,273 A 11/2000 Olsen
6,162,122 A 12/2000 Acres et al.
6,190,255 B1 2/2001 Thomas et al.
6,193,606 B1 2/2001 Walker et al.
6,193,607 B1 2/2001 Kay
6,203,429 B1 3/2001 Demar et al.
6,210,275 B1 * 4/2001 Olsen ..... 463/16
6,234,897 B1 5/2001 Frohm et al.
6,267,669 B1 7/2001 Luciano, Jr. et al.
6,364,765 B1 4/2002 Walker et al.
6,386,974 B1 5/2002 Adams
6,406,369 B1 * 6/2002 Baerlocher et al. ..... 463/20
2003/0064779 A1 4/2003 Suda
2003/0114219 A1 6/2003 McClintic

* cited by examiner

METHOD AND APPARATUS FOR GAMING MACHINES WITH A QUASI-COMPETITION PLAY BONUS FEATURE

BACKGROUND OF THE INVENTION

1. Field of the Invention

The present invention relates to methods, apparatus, and systems for conducting games of chance and, in particular, methods, apparatus, and systems involving gaming machines that may be linked together for quasi-competitive play in a bonus event. Additionally, the invention relates to gaming methods that implement quasi-competition elements in a regulated gaming environment. The invention further relates to methods for increasing and maintaining player interest in gaming machines so as to promote prolonged play and improved player loyalty. In one exemplary embodiment, the present invention comprises a plurality of networked gaming devices for playing a cooperative and/or competitive participation bonus game.

2. State of the Art

Gaming machines have long been a significant feature of the gaming industry. The most basic form of gaming machine is a mechanical device of spinning reels, commonly known as a slot machine. The player wagers an amount and invokes the reels to spin. The reels stop on random positions. If predetermined symbols align on a pay line when the reels stop, then the player is awarded an amount that is inversely proportional to the probability of the alignment of such symbols on the pay line. Alignments of symbols that are relatively less probable to occur correlate with awards that are comparatively larger than awards for alignments of symbols that are relatively more probable to occur.

An important development in the gaming industry has been the implementation of electronic versions of conventional wagering games. Electronic versions of conventional wagering games, e.g., slot machines, poker, blackjack, keno, lotto, and bingo, are now widespread and account for a significant proportion of gaming revenues. It is thought that some players, particularly novices, feel more comfortable playing electronic versions of wagering games because many more people have been exposed to video games than have been exposed to conventional wagering games. Thus, electronic versions of wagering games are an effective means for attracting new players.

Various electronic gaming systems and their associated apparatus and methods of use are well known in the art. Exemplary patents describing games of chance include U.S. Pat. No. 5,947,820 to Morro et al. (slot machine-puzzle game combination), U.S. Pat. No. 5,833,536 to Davids et al. (electronic card games), U.S. Pat. No. 5,820,460 to Fulton (video poker game), U.S. Pat. No. 5,769,716 to Saffari et al. ("falling symbol" game), U.S. Pat. No. 5,351,970 to Fioretti ("Methods and Apparatus for Playing Bingo Over a Wide Geographic Area"), U.S. Pat. No. 5,333,868 to Goldfarb ("Method of Playing a Game of Chance at Locations Remote from the Game Site"), and U.S. Pat. No. 4,856,787 to Itkis ("Concurrent Game Network"), the disclosures of each of which patents are incorporated herein by this reference.

Initiating an electronic gaming machine can be done as simply as by inserting a coin or bill or, more comprehensively, for example, by inserting an identification card, such as a "smart card," which has a programmed microchip or a magnetic strip coded with a player's identification and credit totals. An exemplary gaming machine incorporating "smart card" technology is described in U.S. Pat. No. 5,265,874 to Dickinson et al., the disclosure of which is hereby incorporated herein by this reference. Another exemplary gaming machine incorporating "smart card" technology is described in U.S. Pat. No. 5,806,045 to Biorge et al. ("Biorge"), the disclosure of which is hereby incorporated herein by this reference, which uses a writeable identification card, such as a "smart card," to eliminate the need for a network or direct connection between remote systems and a common controller or point database. The invention disclosed in Biorge can retrieve, record, and update the player's promotional point and credit information using the "smart card." Finally, it is known in the art to transfer money directly to a gaming machine from a player's personal bank account through an electronic funds transfer, as described in U.S. Pat. No. 5,902,983 to Crevelt et al., the disclosure of which is hereby incorporated herein by this reference.

It is thought that the introduction of the element of skill, or at least the perception of the element of skill, into a game will increase player interest in the game, thereby encouraging prolonged play and improved player loyalty to the game. Skills can include a wide variety of physical attributes such as strength, coordination, and endurance, as well as a variety of mental attributes, such as strategy, memory, and endurance. Of these skill elements, mental attributes are particularly suited for gaming applications.

However, one of the objectives of gaming regulation is to ensure that the playing of a gaming device is fair to all players, regardless of any special physical or mental skills of the player. To that end, emphasis has been placed on the use of a random number generator to provide a "level playing field" for each player. To a large extent, this has been a very successful approach to gaming. At first, the random number generator feature was implemented by mechanical means, but mechanical random number generation was less than ideal from statistical and probabilistic perspectives. The shortcomings of the mechanical approach were cured with the advent of computer-based random number generation in gaming devices. In these devices, a random game result can be realized through the use of a software program that ensures a consistently random result that is statistically sound. This approach also allowed for an independent verification of the device, which further assisted in achieving the goal of fairness by further limiting opportunities to cheat the device.

One example of a random number generator is described in U.S. Pat. No. 6,193,607 to Kay ("Kay"), the disclosure of which is hereby incorporated herein by this reference. Kay describes a random number generator that is both statistically and probabilistically accurate. When evaluating random number generators, emphasis is usually placed on a random number generator producing the correct statistical behavior. A series of statistical tests (such as permutation, chi square, and autocorrelation) can demonstrate whether, when measured over a large sample, a random number generator produces behavior that matches that of truly random numbers. A statistically good random number generator can be used accurately in simulations so long as the importance of any one event in a simulation is roughly the same as the importance of any other event. However, statistical testing does not take into account the wide variation in the significance of possible events. If, for example, the random number generator causes a jackpot to be paid once too often where the random number generator has chosen a particular random number once too frequently, which, statistically speaking, does not significantly change the statistics of the random number generator, this one occurrence may cause a large jackpot to be paid out too often, significantly changing the expected payout of the game.

Thus, it is argued in Kay that, in addition to being statistically accurate, a random number generator used for gaming purposes should also be probabilistically accurate, which means that the random number generator produces each possible outcome exactly the correct number of times. For example, probabilistic analysis can show that a random number generator will produce each possible outcome in any game exactly the same number of times as any other outcome. If the game is poker, for example, exactly the same number of royal flushes will occur as will the number of any other specific hand. The statistically and probabilistically accurate random number generator described in Kay assures that no particular jackpot will be overpaid (or underpaid).

With the development of random number generators that provide the "level playing field" mandated by gaming regulation, the next logical step in the evolution of gaming machines included the addition of a subset of mental skills in games, such as video poker and blackjack. In these games, the player can make choices that are similar to those made in the real games. The games can be implemented to ensure that the minimum payout requirement of a jurisdiction can be achieved for an unskilled player, while a skilled player can achieve payout levels exceeding 100%. These types of games have proven to be so popular with players that they are now the most prevalent game types in American casinos.

Recently, some have attempted to introduce skill elements into a slot machine-type of game. One example is the RIPLEY'S BELIEVE IT OR NOT® slot machine game by Mikohn Gaming Corporation. This game has a bonus feature that allows the player to select answers to questions. The player is provided a series of questions and four possible answers for each question. If he answers a question correctly on the first try, he is awarded a specified bonus amount. If he answers it incorrectly on the first try and correctly on the second try, he is awarded a lower specified bonus amount. This continues until his fourth try, at which point he is awarded the minimum specified bonus amount. He then proceeds to answer each successive question in a similar manner. At the end of the session, his total credits are added up, and, if they exceed a certain minimum level, he can proceed to the next level of questions.

While these types of games have gained wide acceptance in modem society, they are generally not permitted within a regulated gaming environment, particularly within the United States, except under very tightly controlled parameters. The primary reason is that these types of video games, in the past, have not been fair to all players if their primary attribute relies on the very distinctions in physical and/or mental abilities that gaming regulation prohibits in gaming machines.

Another advance in gaming machines involves the implementation of a bonus game in association with a primary or base game. In these types of gaming machines, a primary or base game, such as, for example, a slot machine, is provided with a bonus game. A player playing the primary or base game has opportunities to enter the bonus game upon the occurrence of certain specified events. In many cases, the bonus game is a game involving skill, or at least the appearance of the involvement of skill. Exemplary patents involving gaming machines having bonus game features include U.S. Pat. No. 6,193,606 to Walker et al., U.S. Pat. No. 6,203,429 to Demar et al., and U.S. Pat. No. 6,234,897 to Frohm et al., the disclosures of which are hereby incorporated herein by this reference.

Yet another advance in gaming machines relates to the linking of a plurality of gaming machines over a network. U.S. Pat. No. 5,242,163 to Fulton ("Fulton"), the disclosure of which is hereby incorporated herein by this reference, discloses the linking of a plurality of gaming machines to a "control station" to at least announce commencement of play of a secondary, group-oriented game to players at distributed gaming machines normally used for play of another, individually oriented game, such as poker. Fulton specifically discloses his invention in the context of providing the opportunity for individual players to participate in a bingo game without leaving their gaming machines. The bingo game may be conducted manually, using a bingo card secured to the gaming machine, or through the gaming machine itself, linked to the control station.

U.S. Pat. No. 6,039,648 to Guinn et al., the disclosure of which is hereby incorporated herein by this reference, discloses the linking of a plurality of gaming machines to a host computer so that gaming machines at distributed locations may be employed in tournament play. U.S. Pat. No. 6,162,122 to Acres et al., the disclosure of which is hereby incorporated herein by this reference, discloses the linking of a plurality of gaming machines to integrate player tracking, data collection, and bonus events over the same network.

Another recent advance in game playing has been in the area of computer-based and Internet-based video games that are played in a simulated story environment. These new types of video games are able to present a compelling and player-motivated gaming experience by departing from traditional linear storytelling and using such novel concepts as behavior-based, interactive story environments, in which the player takes part in creating the story through the actions he or she takes. In other words, these games enable the player to take part in the "evolution" of the game. An example of such a game is THE SIMS, where no predetermined story actually takes place, but players are able to form their own unique storylines through the creation and development of characters and the exertion of some degree of control over their subsequent interactions. Another example is the game CREATURES, an online community where players can "adopt" Internet creatures and interact with them any way the player desires. As in the case of the game THE SIMS, players of CREATURES develop their own unique storylines through the way they interact with these pets, as well as through the pets' responses to these interactions based on the pets' innate (programmed) personalities. These kinds of behavior-based, interactive story environments are especially effective at maintaining player interest because the player feels that he is intimately involved in the course taken by the game. Furthermore, these story environments give players incentive to play longer and more often in order to further develop the creatures and/or pets they have created. The desirability of the personal interaction element, or at least the impression of interactivity, is based on the psychological principles of identity and ego. By involving a player's own identity and ego in the game experience, the player becomes more personally committed to the game, resulting in longer and more frequent playing sessions. Obviously, longer and more frequent play in the gaming context contributes to the profitability of the gaming enterprise.

One example of a game that allows players to create personalized game identities, or avatars, that engage in battles independent of the players is described in U.S. Pat. No. 6,024,643 to Begis ("Begis"), the disclosure of which is hereby incorporated herein by this reference. In Begis, players create profiles, which are transmitted to a central host. Two or more avatars based on the player profiles are pitted against one another in a pseudo-game independent of any of the profiles' creators. A winner is determined based on resolution of a plurality of inflection points based on underlying constraints, random factors, and the opposing player profile(s).

Thus, it would be advantageous in the gaming industry to provide a method to equalize the physical and mental skill attributes of players in order to make such evolving story games available for use in a regulated gaming environment. Casinos and other gaming enterprises would derive important competitive benefits from being able to provide their customers a gaming experience that imparts at least the perception of skill-based influence over game outcome while maintaining the "level playing field" mandated by gaming regulation.

BRIEF SUMMARY OF THE INVENTION

The present invention provides a player an enhanced gaming experience by using strategy and random selection to impart at least the perception of elements of skill to players in order to provide equal access to quasi-competitive games for players of different skill levels. The gaming machines of the present invention may be configured to have the features of a conventional gaming machine, such as a slot machine or a video poker machine, but include additional features relating to bonus game quasi-competitive play, which features permit a player to participate in a quasi-competitive bonus game from a gaming machine according to the invention. In exemplary embodiments, a plurality of gaming machines of the present invention are linked over a network to enable interactive bonus game play among more than one player or between a player and a computer.

In one embodiment, the invention provides a bonus game comprising a futuristic competition environment such as, for example, an arena for gladiatorial-type contests involving physical combat between opponents that are simulated on a display and accessible by multiple players at different gaming machines and, optionally, at different locations. The competition environment is provided with various competition venues and characters, each character having available to it various competitive advantages which may take the form of different skills and equipment. The characters, competition equipment, and competition venues are modular, allowing the competition environment to be changed and/or updated, as needed or desired to avoid repetition and maintain freshness of the game experience for players within the bounds of the game configuration. The continuous and changing simulation of the competition arena environment gives players the impression of passage of time and events on a virtual world that has no beginning or end but, rather, is constantly evolving.

In another embodiment of the invention, a plurality of gaming machines are linked together over a network to enable players at each of the plurality of gaming machines to participate in a quasi-competitive bonus game against each other. In yet another embodiment of the present invention, the players are enabled to participate in a quasi-competitive bonus game against a computer-generated player. The plurality of gaming machines linked together may comprise at least one bank of gaming machines in at least one gaming location. In still yet another embodiment of the invention, the plurality of linked gaming machines comprises more than one bank of gaming machines. In yet again another embodiment of the present invention, the plurality of gaming machines comprises more than one bank of gaming machines at more than one gaming location.

Upon initiation of the gaming machine for play of the bonus game of the present invention, each player is prompted to create a profile for himself or herself by selecting and configuring a character from a pool of available characters. In yet another embodiment of the present invention, a player can use a previously created profile by inserting a "smart card," inputting a personal identification number, or identifying himself or herself as the creator of the previously created profile by other suitable means. Each character has randomly assigned "skills" that give it various strengths and weaknesses in competitions. The player can customize his or her chosen character by using credits or points to buy additional features, such as, for example, competition equipment, physical characteristics, and special powers. These additional features improve the relative "skills" of the character. In still another embodiment of the present invention, the player may create a completely new character by selecting, for example, the character's height, weight, arm reach, special powers, competition equipment, defensive capabilities, and other features available to the character. In another embodiment of the invention, each character has available to it a unique set of such additional features. As the player earns more credits or points through play of a primary game or through inserting more money, he may use those credits or points to further customize his character in the hope of gaining an advantage in play of a bonus game contest.

In an embodiment of the present invention, a player can save the character he has created for future play through the use of a "smart card," personal identification number, or other means of identifying the player as the creator of the character. In yet another embodiment of the invention, only one player can undertake the role of each character at a time, thereby giving the player a heightened sense of individualism and ownership of his character. This process of selection and customization allows the player to personalize the game according to his own tastes, preferences, and strategies. This personalization may thus encourage the player to play longer and more often in order to further customize his or her character, thereby generating more revenues from the player.

In still another embodiment of the present invention, the player is assigned to a virtual team upon initiation of the gaming machine, which team may include other players at linked gaming machines according to the invention. In another embodiment of the present invention, players at one bank of gaming machines form a team. In yet another embodiment of the present invention, players at one gaming location form a team. In a currently preferred embodiment, players may choose the team to which they want to be assigned.

In a team play embodiment of the present invention, each team may have an associated collective bonus or progressive jackpot. Whenever one member of a team wins a competition in the bonus game, a portion of his winnings are credited to the team's progressive jackpot. The team's progressive jackpot may be distributed to the team upon the occurrence of a specified event in the primary or base game, such as, for example, if the primary or base game is a slot machine-type game, the team's progressive jackpot is paid out when a team member hits a combination of symbols designated for team jackpot payout.

In an embodiment of the invention, a player who is playing the primary or base game is allowed to enter the bonus game only upon the occurrence certain specified events. Specified events allowing a player to enter the bonus game include, but are not limited to, a random timer event, a bonus event trigger in the primary or base game, or a challenge from another player who is already playing the bonus game. In an embodiment of the present invention, the player earns bonus play points, which can be used to enter the bonus game, as a function of the amount of time spent playing the primary or base game. In yet another embodiment of the present invention, a player may enter the bonus game directly, provided he or she has at least the specified minimum number of credits or bonus play points.

In another embodiment of the present invention, players earn additional credits or points by winning competitions in the bonus game. Players may leave credits or points earned in competitions in a purse or they can bank such credits or points. In a preferred embodiment, a player must engage in at least one competition in the bonus game before he or she can bank any credits or points. Credits or points stored in a player's purse may be wagered in bonus game competitions or may be expended to buy additional features for his character. Banked credits or points cannot be taken away from the player and thus constitute actual bonus game winnings.

In an embodiment of the present invention, upon entering the bonus game (not in response to a challenge from another human or computer-generated player), the player is allowed to select the competition venue within the bonus game in which he wants to play. The player then is allowed to view the profiles and purse amounts (available wagers) of the other players, human or computer-generated, who are available to be challenged. The player is then allowed to choose which other player to challenge to a competition or contest. The challenging player must wager an amount on the competition that is equal to or less than the amount in the challenged player's purse. The challenged player will receive a text message indicating that he has been challenged and that he must go to the competition venue selected by the other player or surrender the amount wagered by the challenging player. In another embodiment of the present invention, the message received by a challenged player is announced in an audible voice. In another embodiment of the present invention, the challenge is announced in both a text message and an audible voice message. The challenged player has the option of either accepting the challenge or surrendering to the challenging player. If the challenged player surrenders, his purse is debited by the amount wagered by the challenger and the challenging player's purse is credited in the amount of the wager. If the other player accepts the challenge, a random number generator determines the outcome of the challenge contest, the simulated contest is displayed on the competing players' displays, and the players' respective purses are credited or debited in the amount of the wager.

If the challenging player challenges a computer-generated player to a competition, the challenging player must wager an amount equal to or less than the amount in his purse. If a player is challenged by a computer-generated player, he has the same options available to him as are described above for a human-challenged player.

In an embodiment of the present invention, the simulated contest is also displayed on at least one large common bonus game display that is visible to other players and spectators. In another embodiment, all simulated contests taking place concurrently on any of the linked gaming machines, whether at the same location or at remote locations, are displayed simultaneously on at least one large common display at each location, for example, using large sports-book type displays. By allowing other players and spectators to view competitions in progress, such other players and spectators will become interested in participating in the bonus game and will thus be encouraged to play at the gaming machines of the invention, thus increasing revenues generated.

A player may continue engaging in competitions in the bonus game so long as he has credits or points in his purse. When a player's purse is empty, the player is ejected from the bonus game. In order to return to the bonus game, the player must play the primary or base game to earn at least the minimum amount of credits or points required for reentry into the bonus game. In another embodiment, the player may purchase credits or points in order to enter the bonus game. Because the bonus game is continuously simulated, players can enter and exit the bonus game as many times as they desire. Furthermore, because players may save the characters (profiles) they have created, they can resume playing with their character, if desired, each time they enter the bonus game. Thus the bonus game provides players with an ongoing gaming experience that can be enjoyed over a prolonged period of time and over multiple gaming sessions.

As used herein, the terms "game," "gaming" and "game of chance" each include and encompass not only games having a random or arbitrary outcome, but also such games which also invite or require some player input to the game having at least a potential or perceived potential for affecting a game outcome. Such player input may be generally termed "skill" whether or not such input is in actuality beneficial in terms of game outcome.

BRIEF DESCRIPTION OF THE DRAWINGS

The nature of the present invention, and the various embodiments thereof, may be more clearly understood by reference to the following detailed description of the invention, the appended claims, and the several drawings herein, wherein:

DETAILED DESCRIPTION OF THE ILLUSTRATED EMBODIMENTS

Figure 1:
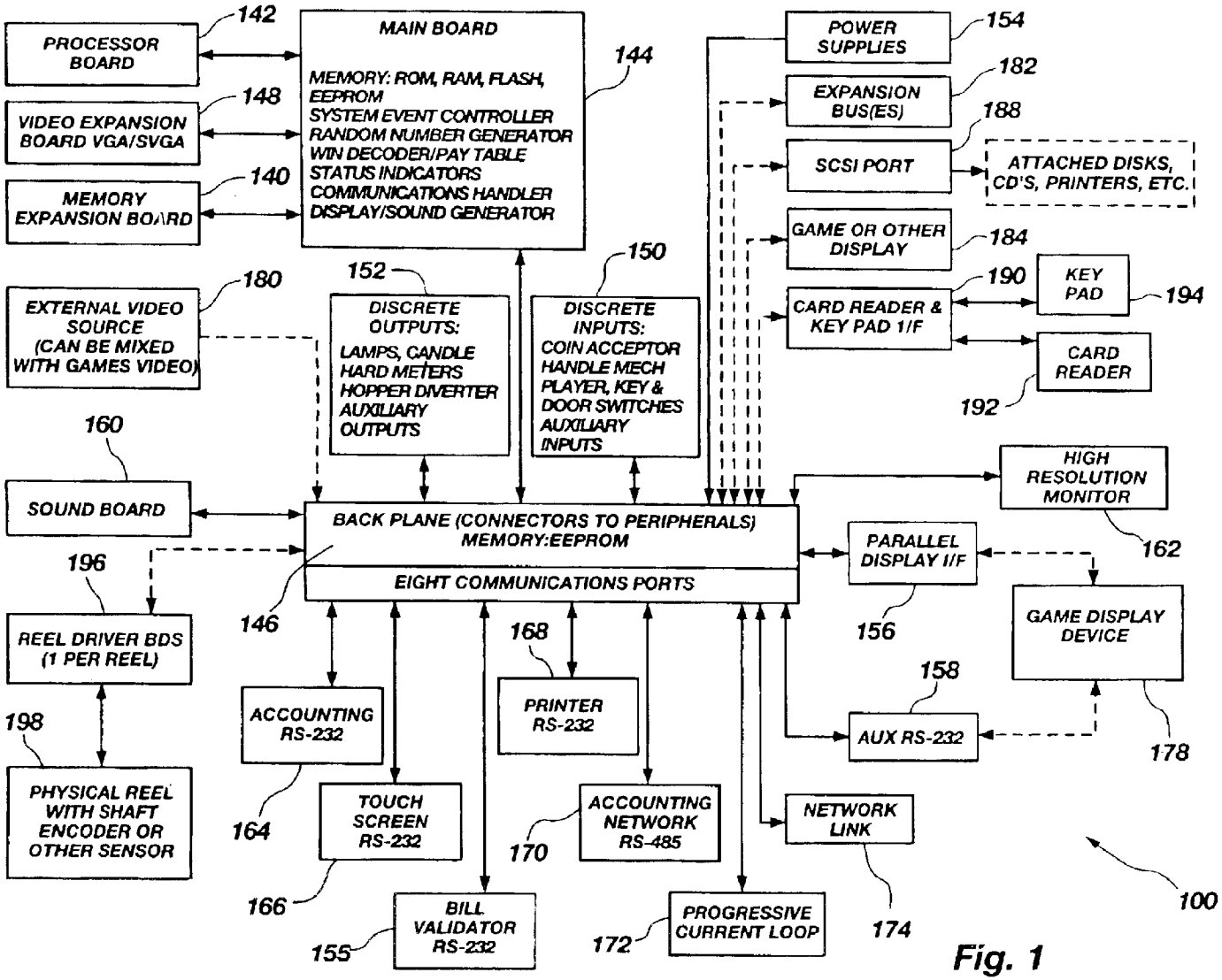
FIG. 1 is a block diagram of an exemplary gaming machine configuration.

In use and operation, and referring to FIG. 1, a gaming machine 100 includes a memory board 140, a processor board 142, a main board 144 and a back plane 146 integrally or separately formed. Memory expansion board 140 as well as processor board 142 including a graphics system processor and video expansion board VGA/SVGA 148 are operably coupled to the main board 144. The main board 144 preferably includes memory in the form of ROM, RAM, flash memory and EEPROM (electrically erasable programmable read only memory). In addition, the main board 144 includes a system event controller, a random number generator, a win decoder/pay table, status indicators, a communications handler and a display/sound generator.

The main board 144 is operably coupled to the back plane 146 may include additional memory, such as in the form of an EEPROM, and connectors to connect to peripherals. Furthermore, the back plane 146 provides a plurality of communication ports for communicating with external peripherals. The back plane 146 provides the coupling between discrete inputs 150 and the processor 148 and main board 144. Typical examples of elements which provide discrete inputs are coin acceptors, game buttons, mechanical hand levers, key and door switches and other auxiliary inputs. Furthermore, the back plane 146 provides the coupling between discrete outputs 152 and the processor and main board 144. Typically and by way of example only, elements that provide discrete outputs are in the form of lamps, hard meters, hoppers, diverters and other auxiliary outputs.

The back plane 146 also provides connectors for at least one power supply 154 for supplying power for the processor and a parallel display interface (PDI) 156 and a serial interface 158 for game display device 178. In addition, the back plane 146 also provides connectors for a soundboard 160 and a high-resolution monitor 162. Furthermore, the back plane 146 includes communication ports for operably coupling and communicating with an accounting network 164, a touch screen 166 (which may also serve as a game display device), a bill validator 155 incorporated in a currency (bill) acceptor, a printer 168, an accounting network 170, a progressive current loop 172 and a network link 174.

The back plane 146 optionally includes connectors for external video sources 180, expansion buses 182, game or other displays 184, an SCSI port 188 and an interface 190 for at least one card reader 192 (debit/credit, player card, etc.) and key pad 194. The back plane 146 may also include means for coupling a plurality of reel driver boards 196 (one per reel) which drive physical game reels 198 with a shaft encoder or other sensor means to the processor board 142 and main board 144 if a gaming machine 100 is configured for play of a reel-type game. Of course, the reels may be similarly implemented electronically by display as video images, technology for such an approach being well known and widely employed in the art. In such an instance reel driver boards 196 and physical game reels 198 with associated hardware are eliminated and the game outcome generated by the random number generator on main board 144 is directly displayed on a video game display 184 and, optionally, on a separate game device display 178, as known in the art. Other gaming machine configurations for play of different wagering games such as video poker games, video blackjack games, video Keno, video bingo or any other suitable primary games are equally well known in the art. It will also be understood and appreciated by those of ordinary skill in the art that selected components of gaming machine 100 may be duplicated for play of a bonus game or event in accordance with the present invention, in that at least a separate board with a second random number generator may be employed, with associated peripherals and links thereto, for play of the bonus game. In the conventional situation wherein the bonus game of the present invention may be operably coupled as a "top box" or otherwise associated with a conventional, existing gaming machine configured for play of a base game, many of the components illustrated in FIG. 1 and described with respect thereto will be duplicated, including separate software and associated memory for conducting play of the bonus game with associated pay tables for the bonus awards. Of course, if the bonus game of the present invention is implemented over a network, it may be administered as described below with respect to FIGS. 2 and 3 and each gaming machine 100 may act as a terminal for interacting with other gaming machines 100 through the network, or through the administering computer if playing against a computer-generated opponent.

Figure 2:
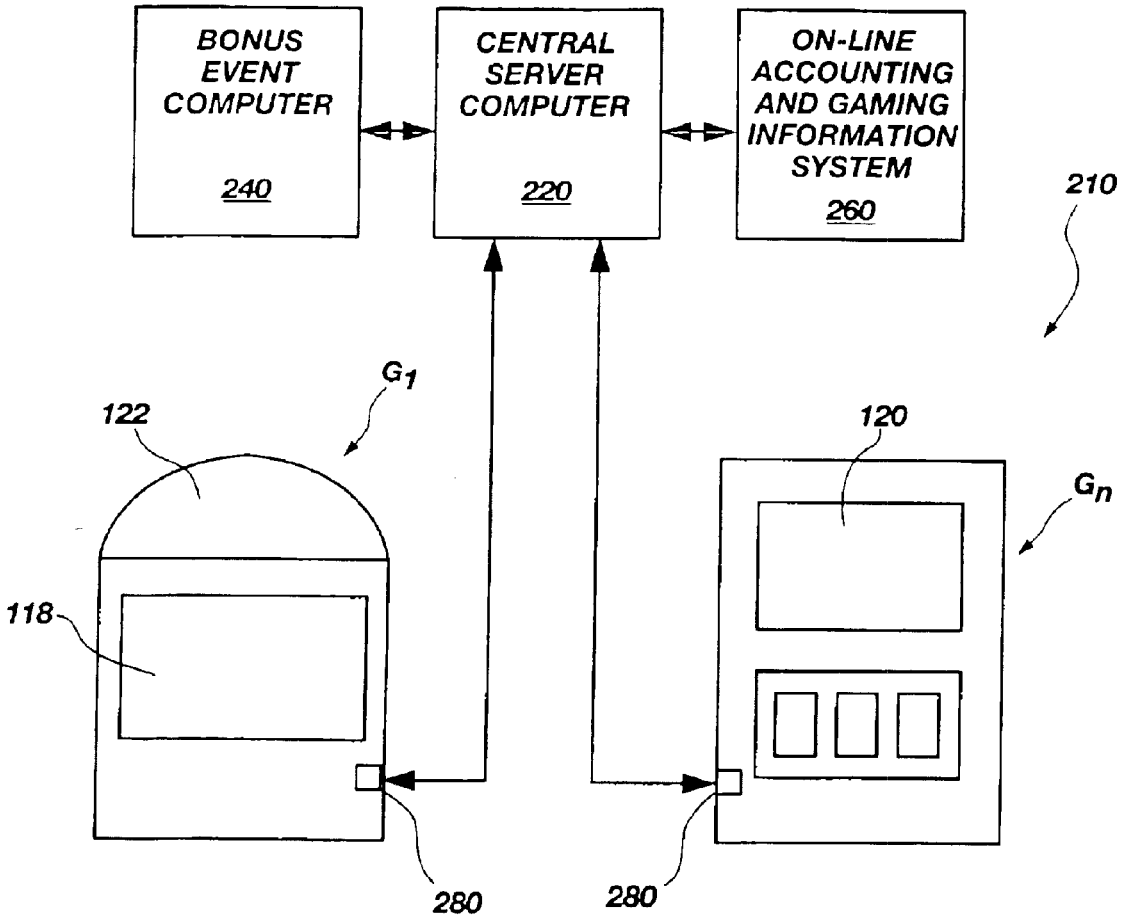
FIG. 2 is a block diagram of an exemplary cooperative and competitive bonus gaming network.
Figure 3:
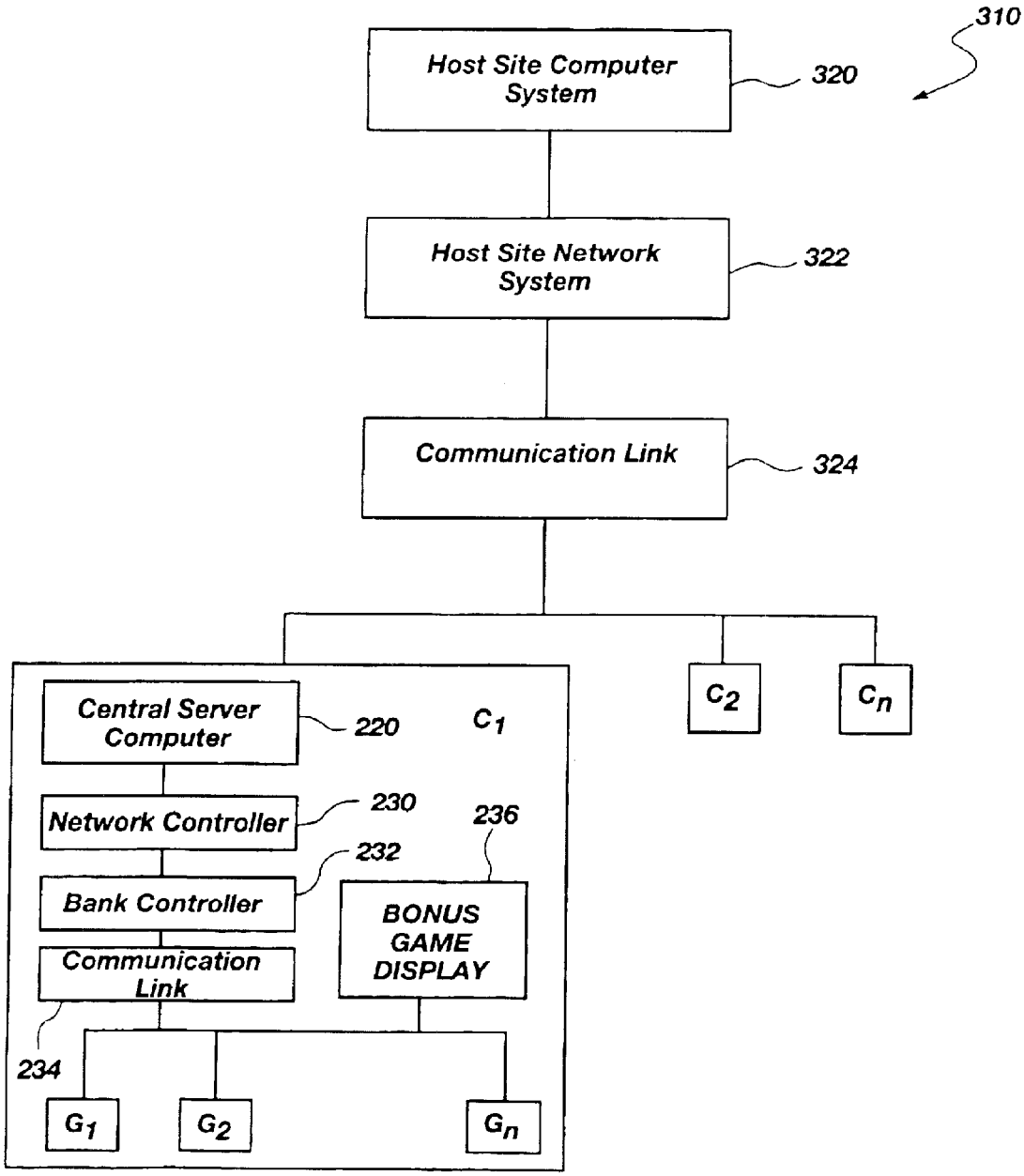
FIG. 3 is a block diagram of an exemplary multi-site cooperative and competitive bonus gaming system.

In implementation of the present invention, the gaming machines offering play of the bonus event of the present invention may be deployed, as schematically depicted in FIG. 2, in a gaming network 210 including a central server computer 220 operably coupled to a plurality of gaming machine $G_1, G_2 \ldots G_n$ which may include both electronic and reel type game machines and be configured in whole or in part as previously described with respect to gaming machine 100 of FIG. 1. It is notable that, unless the gaming network 210 is configured for progressive play, a variety of different makes of gaming machines $G_1, G_2 \ldots G_n$ offering widely different games may incorporated in gaming network 210, since the bonus event operates independently of the primary game on each gaming. The central server computer 220 automatically interacts with a plurality of gaming machines $G_1, G_2 \ldots G_n$ to activate an incoming call or outgoing call bonus event.

More specifically, and again referring to FIGS. 1 and 2, the gaming network 210 includes a central server computer 220, a bonus event computer 240 and a plurality of gaming machines $G_1, G_2 \ldots G_n$. Each gaming machine $G_1, G_2 \ldots G_n$ includes a controller assembly 280 operably coupled to the central server computer 220 and is comprised of a controller unit designed to facilitate transmission of signals from each individual gaming machine $G_1, G_2 \ldots G_n$ to central server computer 220 for monitoring purposes. In addition, the controller assembly 280 includes a network interface board fitted with appropriate electronics for each specific make and model of each individual gaming machine $G_1, G_2 \ldots G_n$.

Referring to FIG. 2, in electronic video games, the central server computer 220 is operably coupled to at least one video game display element 118 as shown at the left hand side of FIG. 2 and sequesters a portion of the video game display element 118 for displaying video attract sequences to attract potential players. Video game display element 118 may be used for display of both the primary and bonus games. Where the gaming network 210 includes reel type game machines $G_1, G_2 \ldots G_n$, as shown at the right hand side of FIG. 2, the central server computer 220 may be operably coupled to at least one active display element 120 so that potential players receive a clear indication of attract sequences and the active display element may be used as a video display for the bonus game. As shown at the left hand side of FIG. 2, the gaming machines $G_1, G_2 \ldots G_n$ may also be provided with a second video display element 122 as an alternative to sequestering a portion of the video game display element 118 for displaying video attract sequences and the bonus game. In addition, the central server computer 220 may include sound generating hardware and software for producing attractive sounds orchestrated with the video attract sequences at each of gaming machines $G_1, G_2 \ldots G_n$ if such is not already incorporated therein. The games support input and output between the player and the game for such devices as heads up display, joystick, keyboard, mouse and data glove via interface modules connected through the expansion bus or buses 182 and SCSI port 188.

The attractive multimedia video displays and dynamic sounds may be provided by the central server computer 220 by using multimedia extensions to allow gaming machines $G_1, G_2 \ldots G_n$ to display full-motion video animation with sound to attract players to the machines. During idle periods, the gaming machines $G_1, G_2 \ldots G_n$ preferably display a sequence of attraction messages in sight and sound. The videos may also be used to market specific areas of the casino and may be customized to any informational needs.

Furthermore, the gaming network 210 includes bonus event computer 240 operably coupled to the central server computer 220 for scheduling bonus parameters such as the type of bonus game, pay tables and players. The functions of central server computer 220 and bonus event computer 240 may, of course, be combined in a single computer. Preferably, the gaming network 210 further includes a real-time or on-line accounting and gaming information system 260 operably coupled to the central server computer 220. The accounting and gaming information system 260 includes a player database for storing player profiles, a player tracking module for tracking players and a pit, cage and credit system for providing automated casino transactions.

As previously implied, a bank of gaming machines $G_1$, $G_2$ . . . $G_n$ may be networked together in a progressive configuration, as known in the art, wherein a portion of each wager to initiate a primary game may be allocated to bonus event wards. In addition, and referring to FIG. 3, a host site computer 320 is coupled to a plurality of the central servers 220 at a variety of remote gaming sites $C_1$, $C_2$ . . . $C_n$ for providing a multi-site linked progressive automated bonus gaming system 310. Of course, a multi-site automated gaming system 310 which is configured for other than progressive play is also encompassed by the present invention.

Preferably, the host site computer 320 will be maintained for the overall operation and control of the system 310. The host site computer 320 includes a computer network 322 and a communication link 324 provided with a high-speed, secure modem link for each individual casino site $C_1$, $C_2$ . . . $C_n$.

Each casino site $C_1$, $C_2$ . . . $C_n$ includes the central server computer 220 provided with a network controller 230 which includes a high-speed modem operably coupled thereto. Bidirectional communication between the host site computer 320 and each casino site central server 220 is accomplished by the set of modems transferring data over communication link 324.

A network controller 230, a bank controller 232 and a communication link 234 are interposed between each central server 220 and the plurality of attached gaming machines at each casino site $C_1$, $C_2$ . . . $C_n$. In addition, the network controller 230, the bank controller 232 and the communication link 234 may optionally be interposed between each central server 220 and at least one separate display 236 at each casino site $C_1$, $C_2$ . . . $C_n$. However, the system 310 may include hardware and software to loop back data for in-machine meter displays to communicate with bonus event award insert areas on gaming machines $G_1$, $G_2$ . . . $G_n$.

It is, of course, contemplated that gaming network 210 as well as gaming system 310 may be implemented using a one or more communication links in combination, including, for example, a Local Area Network (LAN), a Wide Area Network (WAN), the Internet (preferably using encryption), encrypted wireless links, or other suitable links known in or contemplated by the art.

Figure 4:
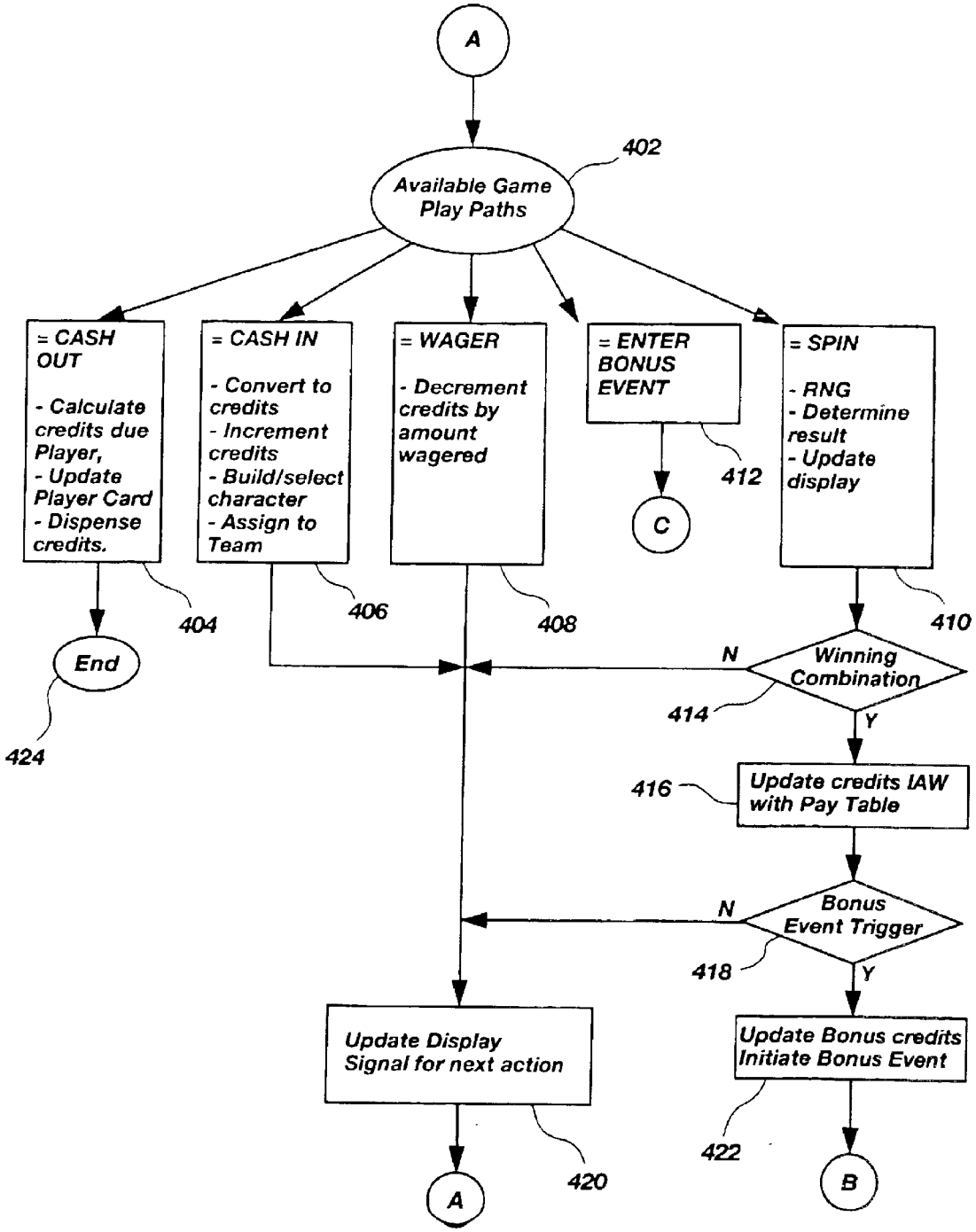
FIG. 4 is an exemplary primary or base game play flowchart.

In operation and referring to drawing FIGS. 1 and 4, the player begins play on the gaming machine 100, which may take a variety of paths as indicated at 402, by first placing cash 406 into the machine via a coin acceptor, dollar bill validator 155, electronic funds transfer, or by credits read from his player card, a debit card or a credit card by a card reader 192. At this juncture, he has the option of selecting a character from a predetermined list of characters or he may build a character from a library of character elements. He may also select a character he previously created by inserting his "smart card" in card reader 192 or by inputting a personal identification number ("PIN") in key pad 194.

The player may also be assigned to be part of a team upon initiating the gaming machine. A team may comprise players playing at a particular bank of gaming machines 100, players playing at a particular gaming location, players who have elected to be members of the same team, or any other group of players selected to form a team.

Once a player's game character has been determined and he or she has been assigned to a team, the player then proceeds to play the primary or base game or go to the Bonus Event 412. Direct entry into the Bonus Event 412 may be made dependent upon how many credits the player has available to him at the time of the selection. For example, a specified number of credits, according to the bonus game configuration, may be used to bypass the primary or base game and enter the Bonus Event 412 directly. If the player decides to play the primary or base game, he or she then determines the amount of wager for the first game and enters that amount 408, which is then decremented from his or her available credit total. Then he or she spins the reels 410 or otherwise plays the primary or base game according to its configuration. The gaming machine 100 determines the result of the primary or base game by using a random number generator to generate an outcome which is compared to a plurality of preselected game outcomes to determine if a winning combination has occurred 414. If so, an award is made and the player's credit balance is updated in accordance with the pay table 416.

If a winning combination is not achieved in primary or base game play, then the display is updated and the player is prompted for his next action 420. The player may cash out 404, in which case the credits due to him are calculated and dispensed to him or her (either literally or as a credit to the player's account) and, if applicable, the information on a player card is updated 424. Alternatively, the player may also put additional cash into the device 406 to continue to wager on the primary or base game or place a wager based on available credits 408. If he or she has sufficient credits, he may decide to enter the Bonus Event 412 directly.

If a winning combination or outcome is achieved during primary or base game play, the player's credits are updated in accordance with the associated pay table value 416. During the play of the primary or base game, a percentage of the winnings of all players on a particular team may be added to a progressive team bonus. One or more of the winning combinations in the primary or base game hit by any player on a given team may be used as a trigger event to cause the team progressive bonus to be distributed to all active team players by means of pay table 416. Thus, players may win at the Bonus Event through prevailing in individual contests against opponents as well as through certain winning outcomes of primary or base game play by team members. The winning combination is further evaluated to determine if it was a Bonus Event Trigger 418. If the winning combination was not the Bonus Event Trigger 418, then the player is prompted to continue play of the primary or base game as described above. If it was a Bonus Event Trigger 418, then the player's bonus credits are updated, and the Bonus Event is initiated 422.

Figure 5:
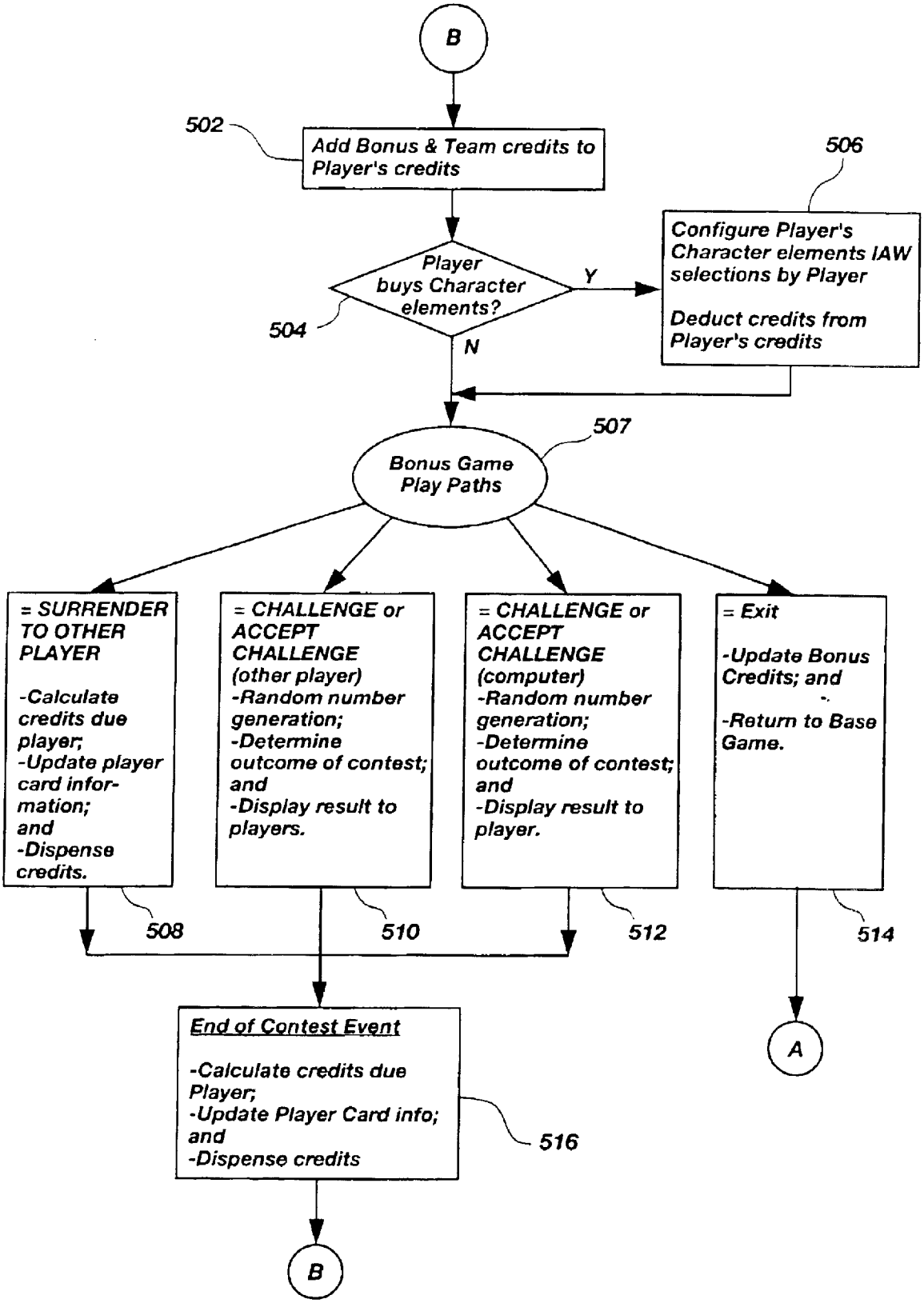
FIG. 5 is an exemplary bonus game play flowchart.

In operation and referring to drawing FIG. 5, entry into the Bonus Event may also be triggered by a randomly timed bonus event trigger in the form of a challenge from the bonus event computer 240 or an opportunity to place a challenge against bonus event computer 240, a challenge from another player, or from a player's decision to enter the Bonus Event to challenge another player.

The randomly timed bonus event trigger is generated from the bonus event computer 240 and selects a player to enter the Bonus Event 412. In a preferred embodiment, the Bonus Event is given a dramatic title, such as "The Thunderdome." Characters may include fanciful or mythical characters have extraordinary physical characteristics, such as "Zavator," the six-armed swordsman. The player who is selected to enter the Bonus Event receives a message such as "You have been challenged by Zavator—Report to the Thunderdome." A Player who has been challenged by another Player having selected another player profile might receive a message such as "You have been challenged by Xzena—Report to the Thunderdome immediately or surrender this amount." These messages can be delivered to the player via text messages appearing on a screen of his gaming machine or via an audible voice instruction. In exemplary embodiments, these messages are delivered via both text messages and audible voice instructions.

Upon entry into the Bonus Event 412, the Player's credits are updated with Bonus and Team credits 502. If the Player is eligible, e.g., if he or she has sufficient credits, to buy additional elements or modify existing elements of his or her character to provide an advantage in bonus game play, he or she is prompted to do so 504. If he or she decides to buy or modify elements of his character, then those character elements are modified in accordance with his selections. His or her credits are reduced according to his selection of character elements 506 and their respective associated values. Character elements may include, by way of example only, choice of height, weight, arm reach, agility, weapons, shield, armor, etc. Some character elements may be made mutually exclusive to others, so that a player may be forced to choose certain elements he or she believes may be beneficial in mounting a challenge for a contest or in defending against one, responsive to the identity of his or her opponent and their profile. Of course, each player is made privy through the display of his or her gaming machine to the opponent's character and associated character elements. Characters may be configured to be more "offensive" or "defensive" in nature or provided with offensive or defensive elements to counter an opponent oppositely configured.

Once the player has configured his character, he then may make certain strategy decisions 507 as to game playing in the Bonus Event. He may, alternatively, bank his earned credits and return to the primary or base game 514.

If the player decides to play the Bonus Event, he may challenge another player 510. If he decides to challenge another player 510, then the challenged player has the opportunity to accept the challenge or to surrender 508. If the other player surrenders, then an amount of the challenged player's credits equal to the amount wagered by the challenging player is debited from the challenged player's credits and credited to the challenging player's credits 508, and the challenging player can determine his next move 507. If the challenged player accepts the challenge, then the outcome of the contest is determined by a random number generator associated with bonus event computer 240, a visual representation of the contest is displayed, and the contest results are displayed to the players 510. During the Bonus Event, certain common Bonus Event elements of game sequence and the display thereof may be randomly changed so as to provide the player with a sense that the Bonus Event is dynamic and evolving. For example, while the outcome of a contest may be substantially controlled as a random event, bonus event computer 240 may be appropriately programmed so that the sequence of actions displayed in a contest differs with each round of play by linking segments or "clips" together in a number of different combinations culminating with the determined outcome or, alternatively, a plurality of complete contest sequences may be preprogrammed and selected for display responsive to the identities of the characters selected by a player or players or bonus event computer 240 and, if a character has been specially configured, responsive to some aspect of the configuration so that a player perceives that he or she has received some value for the credits expended therefore. Thus, both character selection and augmentation by character element selection as well as contest play may be made, in a sense, "modular" so that a substantial, perceptibly infinite number of character profiles and contest sequences to the contest outcome may be made available according to an algorithm forming the basis for a game play architecture of the Bonus Event as displayed.

The player may also decide to challenge a computer-generated character 512 instead of another human player. In the event of a time-triggered challenge by a computer-generated character, the player may accept the challenge 512 or surrender 508 in the manner described for player-to-player challenges. Upon acceptance of a challenge made by the computer-generated character 512 or making a challenge to a computer-generated character 512, a random number generator of bonus event computer 240 will determine the outcome and the contest and results are displayed to the player 512.

When a Bonus Event contest ends, either by default in the case of a surrender to a challenge or through play of a Bonus Event contest to completion, the results are determined and the credits due to each participant are calculated in accordance with a predetermined pay table 516. Each participant's rewards and player status is updated and any credits are dispensed 516. The credits may be banked for future use, used to play again immediately 510, 512 in further challenges, or stored to enable continued play of the primary or base game 514. While it is contemplated that surrendering to a challenge may result in complete loss of player credits in the amount wagered by the challenger, in the event a challenge is accepted, it is contemplated that acceptance of a challenge and play of the ensuing contest may result in an award to both characters or contestants, to incentivize players to accept challenges more frequently.

It will be understood that the Bonus Event as encompassed by the present invention may be implemented with different contest environments as well as with different characters exhibiting different abilities, or profiles, for play. Thus, play in "The Thunderdome" example may take place in, for example, "The Cage of Death" or "The Pit of Fire," the challenging player being prompted and enabled to choose the contest environment.

Although the present invention has been shown and described with respect to preferred embodiments, various additions, deletions, and modifications that are obvious to a person skilled in the art to which the invention pertains, even if not shown or specifically described herein, are deemed to lie within the scope of the present invention as encompassed by the following claims.

What is claimed is:

1. A system for playing a game of chance, comprising:

a plurality of networked gaming machines, each gaming machine of the plurality of gaming machines being adapted for playing a primary game and a bonus game and being adapted to randomly determine an outcome in play of the primary game, the bonus game initiated upon the occurrence of a challenge from another player already qualified to participate in the bonus game and comprising a simulated contest against at least one opponent, each gaming machine of the plurality of gaming machines including at least one bonus game initiation input engageable by a challenged player to perform one of accepting the challenge, whereupon the bonus game is initiated, and rejecting the challenge, whereupon a quantity of credits are debited from the challenged player and credited to the another player; and each gaming machine of the plurality of gaming machines including at least one bonus game input engageable by a player to select a bonus game character to represent the player in the simulated contest against the at least one opponent, and to modify one or more aspects of the bonus game character by selecting bonus game character elements from a library of available bonus game character elements.

2. The system of claim 1, the at least bonus game input of each gaming machine of the plurality of gaming machines being engageable by a player to select a team on which the bonus game character participates in the simulated contest.

3. The system of claim 1, wherein selected bonus game characters of at least two gaming machines of the plurality of gaming machines define a first team of bonus game characters and selected bonus game characters of at least two other gaming machines of the plurality of gaming machines define a second team of bonus game characters, the first team of bonus game characters competing against the second team of bonus game characters in the simulated contest.

4. The system of claim 3, wherein the plurality of gaming machines comprises at least first and second banks of gaming machines, each bank of gaming machines including at least two gaming machines, and wherein the first team is defined by selected bonus game characters of the at least two gaming machines in the first bank of gaming machines and the second team is defined by selected bonus game characters of the at least two gaming machines in the second bank of gaming machines.

5. The system of claim 3, wherein the plurality of gaming machines comprises gaming machines at at least first and second gaming locations, each gaming location including at least two gaming machines, and wherein the first team is defined by selected bonus game characters of the at least two gaming machines at the first gaming location and the second team is defined by selected bonus game characters of the at least two gaming machines at the second gaming location.

6. The system of claim 3, wherein the first and second teams each have an associated progressive jackpot, and a portion of winnings realized when one of the selected bonus game characters of the first team defeats one of the selected bonus game characters of the second team in the simulated contest is credited to the associated progressive jackpot of the first team.

7. The system of claim 1, wherein an outcome of the simulated contest is randomly determined.

8. The system of claim 1, wherein each of the bonus game character elements available for selection provides a player's selected character with different competitive advantages as compared to other of the bonus game character elements, whereby a player's selection of one or more of the bonus game character elements allows the player to improve the player's probability of winning the simulated contest.

9. The system according to claim 1, the at least one bonus game input engagable by a player to select the bonus game character from a library of available bonus game characters.

10. The system according to claim 1, the at least one bonus game input engagable by a player to select the bonus game character selected in a previous bonus game.

11. The system according to claim 1, wherein the opponent comprises another bonus game character.

12. The system according to claim 11, wherein the simulated contest comprises a simulation of combat.

13. The system according to claim 12, wherein the simulated contest comprises a visual representation on a display of the simulation of combat.

14. The system according to claim 13, wherein the simulated contest comprises a substantially continuous display of competition to provide a visual perception of being ongoing.

15. The system according to claim 12, wherein the bonus game character and the simulation of combat are structured from a selection of modular components.

16. The system according to claim 1, wherein the simulated contest comprises a gladiatorial-type contest.

17. The system according to claim 1, wherein the simulated contest comprises a display of physical competition between an offensive character and a defensive character.

18. The system according to claim 1, wherein the primary game comprises at least one of reel-type slot machine games, card games, keno games, lotto games, and bingo games.

19. The system according to claim 1, wherein each gaming machine includes a random number generator.

20. The system according to claim 1, wherein the player is also provided an opportunity to play the bonus game upon the occurrence of at least one bonus game trigger event, the at least one bonus game trigger event comprising at least one of a randomly timed bonus trigger event, a specified outcome in the primary game, and use of a specified number of credits to buy into the bonus game.

* * * * *